United States Patent [19]

Nous

[11] Patent Number: 5,030,326

[45] Date of Patent: Jul. 9, 1991

[54] PASTE-LIKE MIXTURE FEED DEVICE

[75] Inventor: Jean P. Nous, Franqueville-St. Pierre, France

[73] Assignee: S.E.M.T.I. Société a Responsabilité Limitée, France

[21] Appl. No.: 422,050

[22] Filed: Oct. 16, 1989

[51] Int. Cl.[5] ..... D21F 1/08

[52] U.S. Cl. ..... 162/258; 162/343

[58] Field of Search ..... 162/336, 343, 344, 380, 162/381, 259, 258; 366/150, 167, 173, 177

[56] References Cited

U.S. PATENT DOCUMENTS

| | | | |
|---|---|---|---|
| 4,021,295 | 5/1977 | Schmaeng | 162/343 |
| 4,384,922 | 5/1983 | Stotz | 162/343 |
| 4,515,655 | 5/1985 | Schaefer | 162/57 |
| 4,526,653 | 7/1985 | Andersson | 162/343 |
| 4,604,164 | 8/1986 | Fujiwara et al. | 162/343 |
| 4,765,868 | 8/1988 | Fujiwara | 162/343 |

FOREIGN PATENT DOCUMENTS

| | | | |
|---|---|---|---|
| 3422846 | 12/1984 | Fed. Rep. of Germany | 162/336 |
| 1429879 | 1/1966 | France . | |
| 1571410 | 6/1969 | France . | |
| 2107699 | 5/1972 | France . | |

*Primary Examiner*—Karen M. Hastings

*Attorney, Agent, or Firm*—Bachman & LaPointe

[57] ABSTRACT

A feed device for paste-like mixtures such as paper pulp is designed to form a flat film of paste through at least one nozzle at the outlet from a distribution chamber. Paste-like mixture feed circuits discharge into the distribution chamber and each circuit comprises a liquid feed channel and a concentrated paste feed channel each incorporating a flowrate adjuster valve and connected downstream of the valves by a mixer. The mixer comprises an outlet connected to an inlet of the distribution chamber. The distribution chamber comprises ejection channels delimited by longitudinal partitions. Each circuit is in corresponding relationship with one ejection channel.

11 Claims, 2 Drawing Sheets

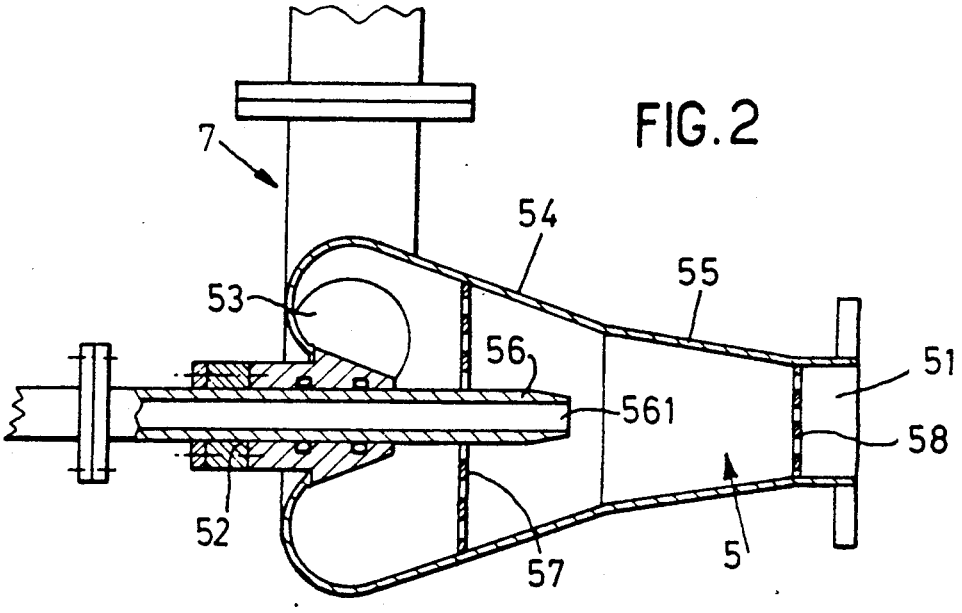
FIG. 2
FIG. 3
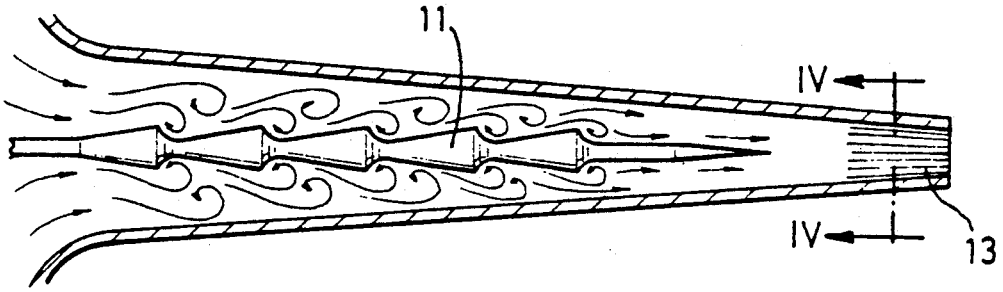
FIG. 4
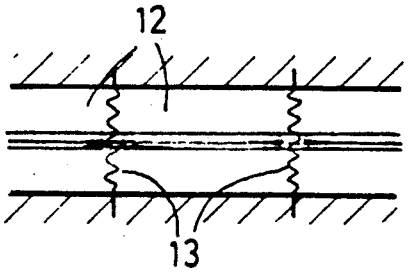

PASTE-LIKE MIXTURE FEED DEVICE

BACKGROUND OF THE INVENTION

1. Field of the invention

The invention concerns a feed device for paste-like mixtures (such as paper pulp) adapted to form a flat film of paste through a nozzle disposed at the outlet of a distribution chamber.

1. Description of the prior art

Known devices of this type designed for dispensing and forming fibrous or otherwise flat films from a paste-like mixture use a "liquid" process which is so-called because the moisture content is high, for example in the order of 99.4% in the case of paper pulp; in these flat films the concentration of the mixture is variable; the concentration is adjusted upstream of a set of circuits feeding a "chamber" dispensing the mixture to a nozzle feeding the paste to a drum (or between two drums) carrying drain cloths; the density of the flat film is varied by sectional control of the throughput of paste by locally moving further apart or closer together the lips of the nozzle disposed at the outlet from the distribution chamber; modifying the speed of the jet at constant concentration controls the density as required but also modifies the machine direction/crosswise direction resistance vector.

An object of the invention is to remedy this disadvantage and to provide a paste-like mixture feed device which is simple, reliable, inexpensive and easy to use.

SUMMARY OF THE INVENTION

The invention consists in a feed device for paste-like mixtures such as paper pulp designed to form a flat film of paste and comprising at least one nozzle and a distribution chamber for forming the flat film of paste through the nozzle which is disposed at the outlet from the distribution chamber, the device comprising a plurality of paste-like mixture feed circuits discharging into the distribution chamber and each comprising a liquid feed channel and a concentrated paste feed channel each incorporating a flowrate adjuster valve and connected to the downstream side of said valves by a mixer having an outlet connected to an inlet of the distribution chamber, which comprises ejection channels delimited by longitudinal partitions, each circuit corresponding to one ejection channel.

By virtue of these provisions the device enables independent, sectional control in the crosswise ejection direction of the nozzle of the concentration and of the flowrate and the density is no longer conditioned only by the flowrate adjustment.

Other characteristics and advantages of the invention will emerge from the following description of a preferred embodiment given by way of non-limiting example and with reference to the appended drawings.

BRIEF DESCRIPTION OF THE DRAWINGS

FIG. 2 is a schematic view of one embodiment of an injector-mixer designed to be fitted to a device in accordance with the invention, shown partly in cross-section.

FIG. 3 is a very much enlarged partial schematic longitudinal cross-section through part of the nozzle of the distribution chamber from FIG. 2.

FIG. 4 is a partial schematic transverse cross-section of the nozzle from FIG. 3 on the line IV—IV in FIG. 3.

DETAILED DESCRIPTION OF THE INVENTION

Figure 1:
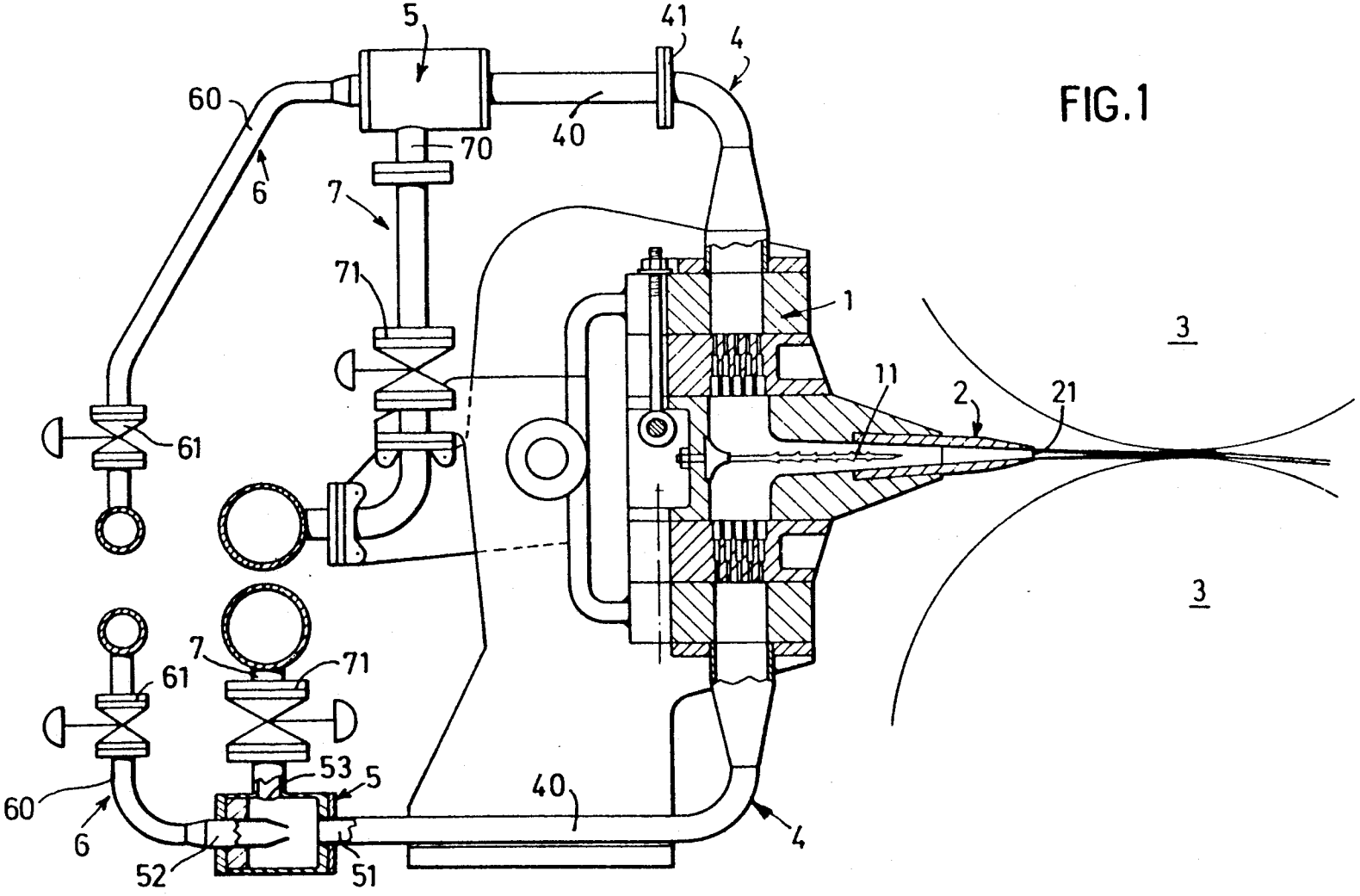
FIG. 1 is a schematic representation of a device in accordance with the invention, partly in cross-section, in particular in the area of its distribution chamber.

The device shown in FIG. 1 is of the dual circuit type designed to feed a paste-like fibrous mixture, to be more precise paper pulp, by means of one or more jets to the gap between two rollers of a papermaking machine so as to form by means of the two rollers (which carry shaping drain cloths) a flat film of pulp which will then be dried to form paper.

The device comprises a pulp distribution chamber 1 with at least one pulp outlet nozzle 2, the ejection orifices 21 of which are held fixed in the immediate proximity of the gap between the two rollers 3 and the imaginary longitudinal axial extension of which passes through this gap, for example at substantially the same distance from the two rollers 3. One or more sets of paste-like mixture feed circuits discharge into the distribution chamber 1, each consisting of one or more paste-like mixture feed circuits 4 each incorporating a concentrated pulp and diluting liquid injector-mixer 5 and two channels 6, 7 respectively feeding the pulp and the liquid to the injector-mixer.

Although the device as shown in the drawings has a single distribution chamber 1 fitted with a single outlet nozzle 2 and fed by one set 4 of two feed circuits, the device may comprise multiple distribution chambers disposed side by side each fitted with multiple nozzles aligned in a direction parallel to the respective longitudinal axes of the two drums 3. Similarly, multiple aligned sets of feed circuits may discharge into the distribution chamber 1, being also aligned in a direction parallel to the same longitudinal axes.

The distribution chamber 1 and the outlet(s) 51 of the injector-mixers 5 of each paste-like mixture feed circuit 4 are connected by pipes 40 discharging at respective inlets in the upper part and the lower part of the distribution chamber 1, the pipes 40 possibly comprising multiple segments joined by flanges 41; on the side opposite their outlet(s) 51 for one or more paste-like mixture feed pipe(s) 40, the injector-mixers 5 comprise an inlet 52 at which discharges a concentrated pulp feed pipe 60 which is part of the pulp feed channel 6. The diluting liquid feed pipe 70 which forms part of the liquid feed channel 7 discharges into the injector-mixer in an orthogonal direction at a liquid inlet 53.

To enable the flowrate and the concentration to be individually adjusted on each circuit of the set of circuits feeding the distribution chamber, a concentrated pulp adjuster valve 61 is incorporated into the concentrated pulp feed channel 6 to each injector-mixer from a concentrated pulp feed device and a diluting flowrate adjuster valve 71 is incorporated into the diluting liquid feed channel 7 from a liquid feed device.

The moving members of the pulp flowrate adjuster valves 61 and diluting liquid flowrate adjuster valves 71 can be connected to manual control means or to automatic control means such as a computer controlled manually or automatically on the basis of set points and information sent from measuring devices by any known transmission means (not shown in the drawings). In this instance this information and these set points relate to controlling the profile, the weight and the resistance characteristics of the resulting film in the distribution direction and in the crosswise direction.

The result is the possibility of independent continuous and sectional adjustment of the concentrated pulp flowrate and the diluting liquid flowrate in the crosswise direction of ejection and consequently of the concentration of the overall flowrate, which enables continuous control over the distribution direction/transverse direction resistance characteristics of the film that is formed, while adjusting the pulp flowrate enables continuous control of the mass per unit surface area of the film in the section concerned.

The injector-mixers 5 downstream of the valves are substantially frustoconical in shape (FIG. 2), consisting for example of two frustoconical sections 54, 55 joining end-to-end with different cone angles but in the same direction, their diameter decreasing from their base at which is located the inlet 52 for the concentrated pulp to the end at which is located the paste-like mixture outlet 51; the inlet 53 for the diluting liquid is near the pulp inlet 52 but its central axis is orthogonal to that of the latter, that is to say to the longitudinal axis of the injector-mixer; the pulp inlet 52 is provided with an injection nozzle 56 with an outlet whose longitudinal position relative to the injector-mixer is adjustable over a certain range around the central region thereof; however, the outlet 561 from the nozzle remains at all times forward of a perforated grid 57 extending transversely into the injector-mixer and delimiting, to the rear of the latter (that is to say, at its largest diameter end) an inlet chamber for the diluting liquid into which discharges the liquid feed channel 7; a second perforated grid 58 extends forward of the first and of the concentrated pulp inlet nozzle outlet 561, parallel to the first perforated grid 57, in other words transversely to the injector-mixer; it delimits towards the front a paste-like mixture outlet chamber into which the outlet pipe discharges. To facilitate the attachment of the various pipes the two inlets 52 and 53 and the outlet 51 are provided with flanges.

In the outlet region of the distribution chamber 1, to the rear of the nozzles 2, there is a horizontal longitudinal shaping tang 11 (FIG. 3) deigned to favor the correct distribution of the paste-like mixture, as a result of turbulence; the tang 11 has an upper surface and a lower surface that are symmetrical to each other, with a sawtooth profile in longitudinal cross-section in which the teeth have a shallow inclined rear edge and a steep inclined front edge and a rounded bottom. In the region of the tang 11 the distribution chamber is partitioned (FIG. 4) so that there corresponds to each circuit of the set of feed circuits an ejection channel 12 created by partitioning the transverse cross-section of the outlet region; the partitions 13 therefore extend longitudinally in this area, that is to say also in the ejection direction, and vertically, to the end of the shaping tang, or beyond it towards the front if necessary, the computation being done individually for each case; the partitions 13 are of undulating shape at least in their end part, on the jet outlet side, in order to prevent any hydraulic marking affecting the formation of the film.

The concentrated pulp and the diluting liquid with flowrates selected in particular according to the required density and resistance of the film determined in sections across the width thereof are therefore fed into the injector-mixers 5 from which the mixture is directed by the feed circuits 4 into the feed chamber 1; the paste-like mixture is then injected from the feed chamber through the nozzles 2 between the two rollers 3, without any hydraulic marking occurring.

Of course, the invention is not limited to the embodiment shown and described above, and other embodiments could be put forward without departing from the scope of the invention.

What is claimed is:

1. Paste-like mixture feed device for mixtures designed to form a flat film of paste, and comprising at least one distribution chamber having several inlets and at least one outlet, and a respective nozzle connected to each outlet for forming said flat film of paste through said nozzle, the device further comprising a plurality of paste-like mixture feed circuits each discharging into one of said inlets of said distribution chamber and each comprising a liquid feed channel, a concentrated paste feed channel and a mixer having two inlets and one outlet, each of said liquid feed channel and paste feed channel incorporating a flowrate adjuster valve and being connected at the downstream side of said valve to a respective inlet of said mixer, said outlet of said mixer being connected to a corresponding inlet of said distribution chamber, which comprises ejection channels delimited by vertical partitions extending longitudinally, each mixture feed circuit corresponding to one ejection channel.

2. Device according to claim 1 wherein said mixers each comprises two opposite sides of which one is formed with said two inlets and the other is formed with said outlet, and one of said inlets discharges into said mixer in the proximity of the other of said inlets, and said other inlet is separated from said outlet by a perforated grid and said one of said inlets is separated from said outlet by two perforated grids.

3. Device according to claim 1 characterized in that the general shape of each of said mixers is frustoconical.

4. Device according to claim 1 characterized in that said distribution chamber comprises sides having a sawtooth profile longitudinal cross-section.

5. Device according to claim 1 characterized in that said partitions are undulated at least over part of their length.

6. Device according to claim 1 characterized in that said mixers each comprise at least one nozzle having a longitudinal position and means for adjusting the longitudinal position of said at least one nozzle.

7. Paste-like mixture feed device for mixtures designed to form a flat film of paste and comprising at least one nozzle and a distribution chamber for forming said flat film of paste through said nozzle which is disposed at an outlet of said distribution chamber, the device further comprising a plurality of paste-like mixture feed circuits discharging into said distribution chamber and each comprising a liquid feed channel and a concentration paste feed channel each incorporating a flowrate adjuster valve and being connected at the downstream side of said valve to a mixer comprising two opposite sides of which one is formed with a first inlet for said concentrated paste feed channel and the other is formed with an outlet, a second inlet for said liquid feed channel discharging into said mixer in the proximity of said first inlet, said first inlet being separated from said outlet by a perforated grid and said second inlet being separated from said outlet by two perforated grids, and said outlet of said mixer is connected to an inlet of said distribution chamber which comprises longitudinal partitions delimiting ejection channels each corresponding to a respective mixture feed channel.

8. Device according to claim 7 characterized in that the general shape of each of said mixers is frustoconical.

9. Device according to claim 7 characterized in that said distribution chamber comprises a horizontal shaping tang with respective upper and lower sides having a sawtooth profile longitudinal cross-section.

10. Device according to claim 7 characterized in that said partitions are undulated at least over part of their length.

11. Device according to claim 7 characterized in that said mixers each comprise at least one nozzle having a longitudinal position and means for adjusting the longitudinal position of said at least one nozzle.

* * * * *